US006536934B2

(12) United States Patent
Fan Wong

(10) Patent No.: US 6,536,934 B2
(45) Date of Patent: Mar. 25, 2003

(54) DECORATIVE LIGHT PLUG

(76) Inventor: Tsui-Tuan Fan Wong, 15th Fl.-D, No. 81, Sec. 1, Hsintai 5th Rd., Hsitzu City, Taipei Hsien (TW)

( * ) Notice: Subject to any disclaimer, the term of this patent is extended or adjusted under 35 U.S.C. 154(b) by 0 days.

(21) Appl. No.: 09/784,777

(22) Filed: Feb. 15, 2001

(65) Prior Publication Data

US 2002/0110001 A1 Aug. 15, 2002

(51) Int. Cl.[7] ..... A47G 35/00

(52) U.S. Cl. ..... 362/565

(58) Field of Search ..... 362/565, 582, 362/226, 219

(56) References Cited

U.S. PATENT DOCUMENTS 5,964,518 A * 10/1999 Shen ..... 362/217

* cited by examiner

*Primary Examiner*—Sandra O'Shea
*Assistant Examiner*—Bertrand Zeade
(74) *Attorney, Agent, or Firm*—Alan Kamrath; Rider, Bennett, Egan & Arundel, LLP

(57) ABSTRACT

A decorative light plug has a collar slidably retained on the decorative light and having a through hole defined through the collar and an inner thread formed on an inner face defining the through hole; a female connector integrally formed on the decorative light and having a flange formed on an outer periphery of the decorative light; and a cover having a blind hole defined to enclose a distal end of the decorative light and an outer thread formed to correspond to the inner thread in the collar. With such an arrangement, the engagement between the cover and the collar is able to protect the distal end of the decorative light.

2 Claims, 3 Drawing Sheets

DECORATIVE LIGHT PLUG

BACKGROUND OF THE INVENTION

1. Field of the Invention

The present invention relates to a decorative light plug, and more particularly to a decorative light plug detachably connected with a distal end of the decorative light so as to protect the distal end of the decorative light from damage.

2. Description of Related Art

A kind of light is made by connecting numerous small light sources in series and encapsulating them in a flexible and transparent plastic material so that the light sends out soft light and provides a decorative effect. Since the light sources are connected in parallel, it is important to provide a secure connection between adjacent lights. A conventional decorative light plug is shown in FIG. 3. The plug (4) is integrally formed on a distal end of the decorative light to protect the connection between adjacent lights (not shown) inside the decorative light from damage. When the decorative light of this kind is to be extended, the user will have to cut off the plug (4) and reconnect the distal end of the decorative light with a distal end of another decorative light, which is not only troublesome, but also a waste of material.

To overcome the shortcomings, the present invention tends to provide an improved decorative light plug to mitigate and obviate the aforementioned problems.

SUMMARY OF THE INVENTION

The primary objective of the invention is to provide an improved decorative light with a plug detachably connected to the decorative light. The plug has a collar slidably retained on the decorative light and a cover detachably connected with the collar, such that when the decorative light is not in use, the cover is able to connect with the collar to protect the distal end of the decorative light from damage.

Other objects, advantages and novel features of the invention will become more apparent from the following detailed description when taken in conjunction with the accompanying drawings.

DETAILED DESCRIPTION OF PREFERRED EMBODIMENT

Figure 1:
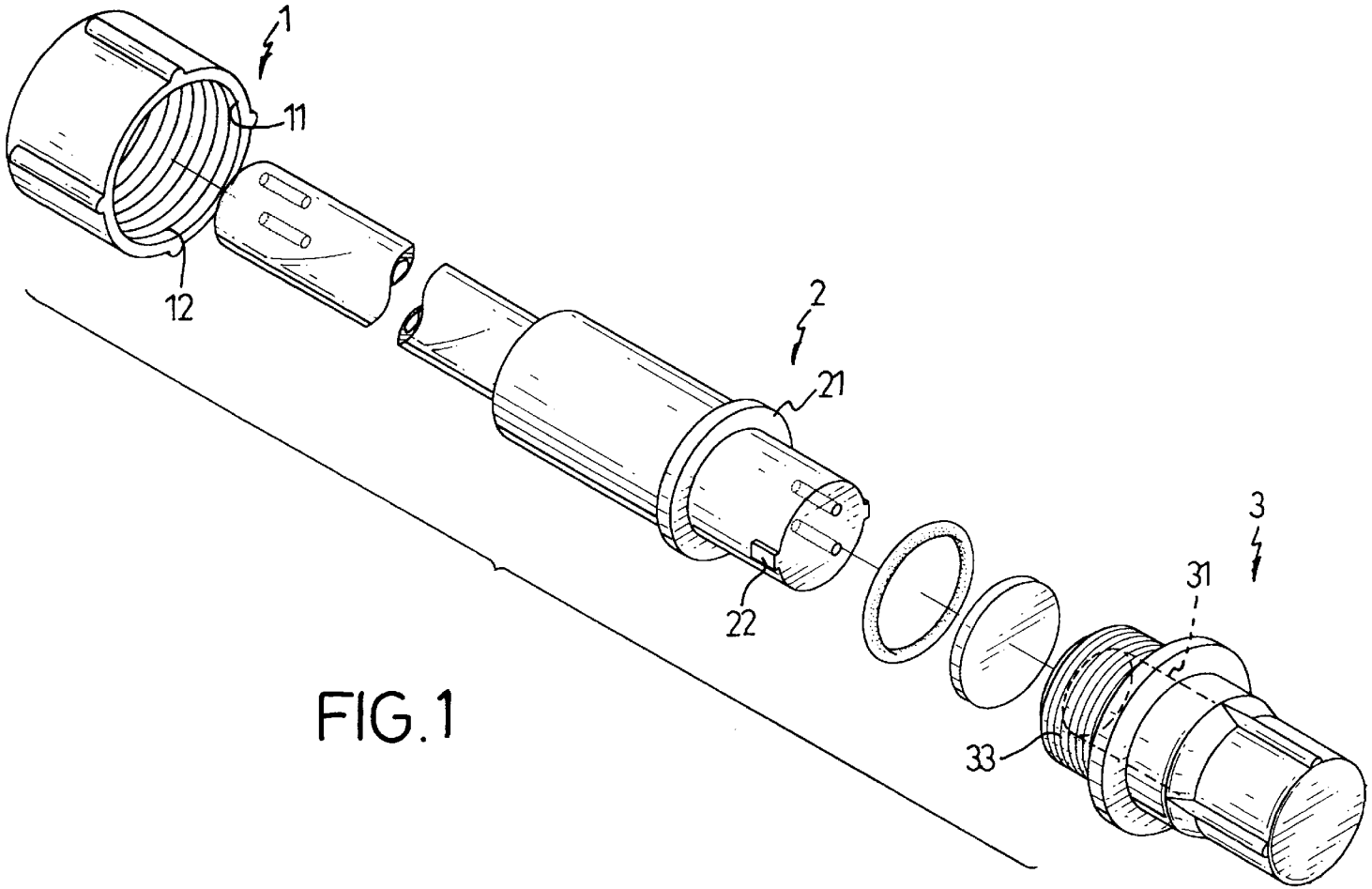
FIG. 1 is an exploded perspective view of the decorative light plug in accordance with the present invention together with the decorative light.

With reference to FIG. 1, the decorative light plug has a collar (1), a female connector (2) and a cover (3).

The collar (1) has a through hole (11) defined through the collar (1) and an inner thread (12). The collar is slidably retained on the decorative light.

The female connector (2) is integrally formed on a distal end of the decorative light and has a flange (21) formed on an outer periphery of the female connector (2) and a pair of keys (22) formed on opposite sides of the distal end of the female connector (2).

Figure 2:
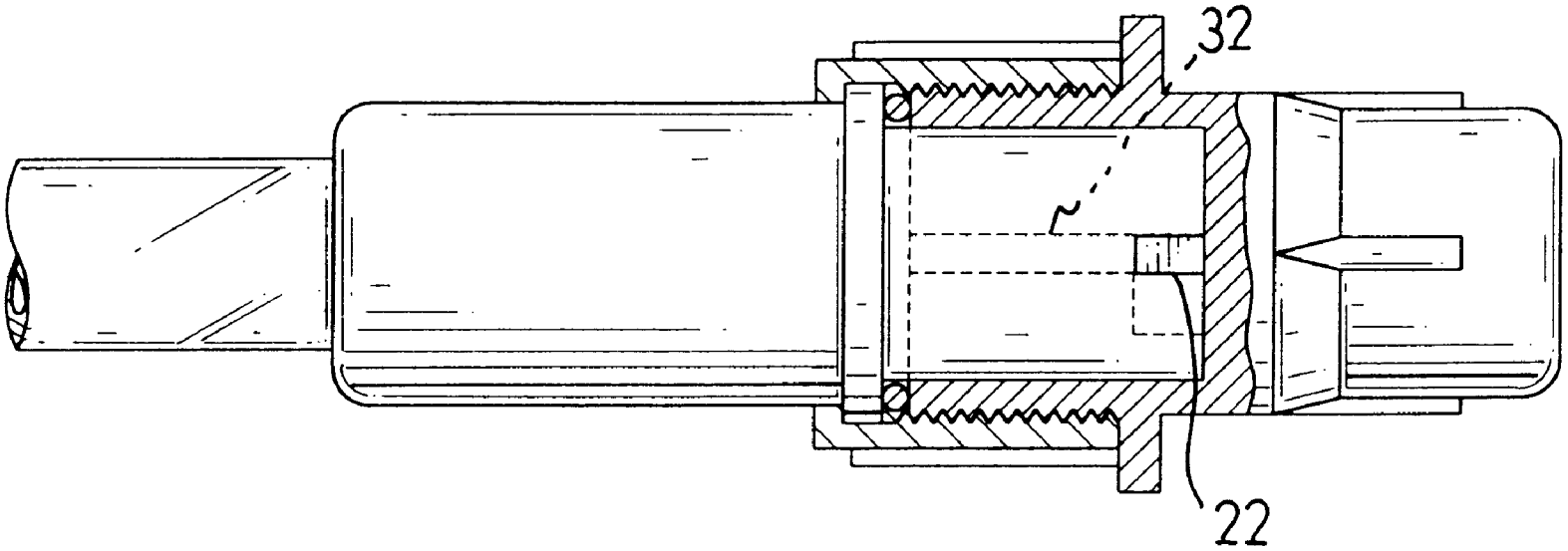
FIG. 2 is a side view in partial cross section of the decorative light plug in FIG. 1 showing the engagement between the cover and the collar.
Figure 3:
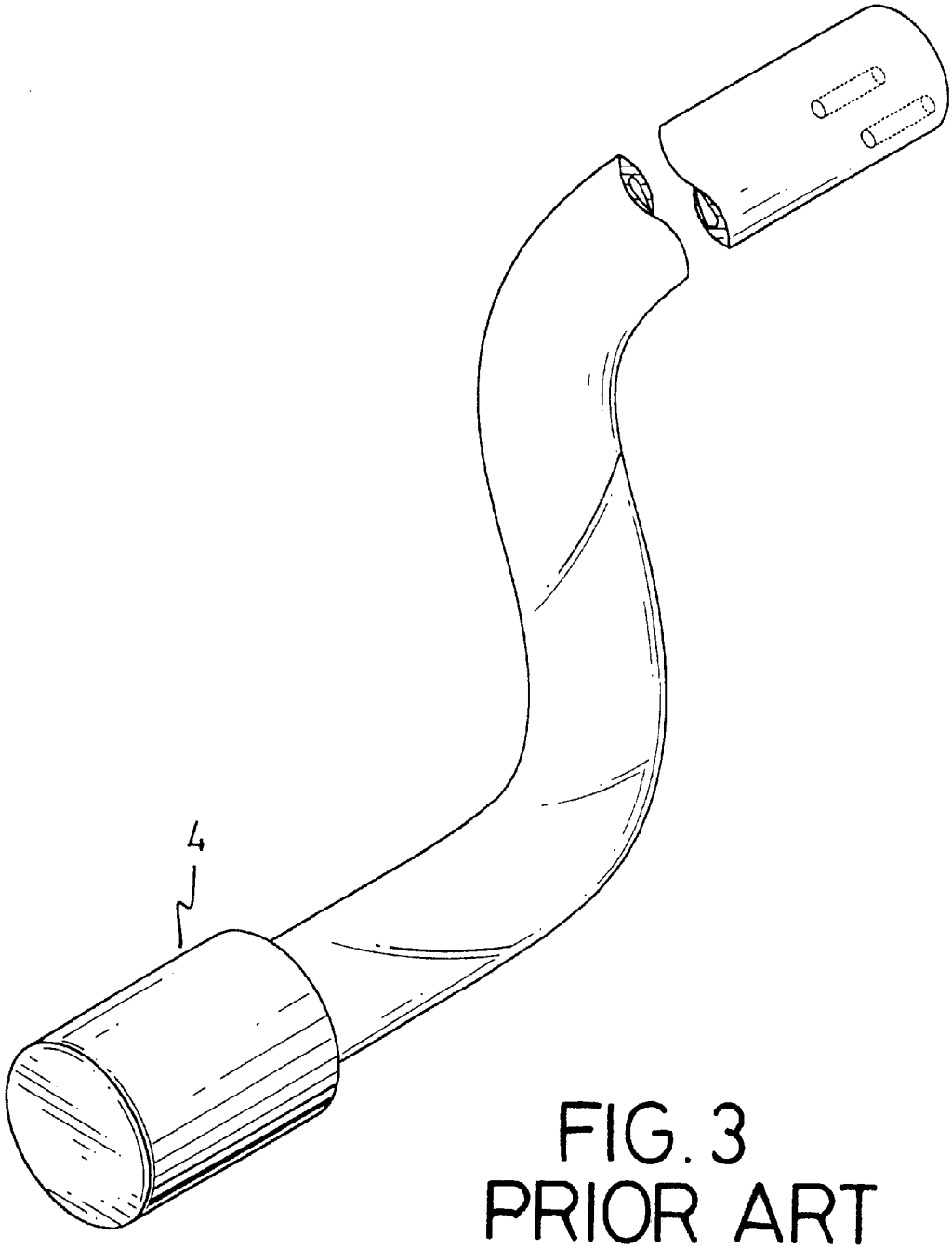
FIG. 3 PRIOR ART
FIG. 3 is a perspective view of a conventional decorative light plug.

The cover (3) has a blind hole (31), a pair of keyways (32) and an outer thread (33). The blind hole (31) is defined to enclose the distal end of the decorative light. The keyways (32) formed on an inner face defining the blind hole (31), as shown in FIG. 2, and correspond to the keys (22) on the female connector (2). The outer thread (33) is formed to correspond to the inner thread (12) on the collar (1).

When the decorative light is not in use, the user may use the collar (1) to connect the cover (3) by screwing the inner thread (12) of the collar (1) onto the outer thread (33) of the cover (3). With such an arrangement, the distal end of the decorative light is protected from damage from the environment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug for a decorative light having a distal end comprising:

a collar slidably retained on the decorative light and having a through hole defined through the collar and an inner thread formed in an inner face defining the through hole;

a female connector having an inner periphery adapted to be integrally formed on the distal end of the decorative light and having an outer periphery, with the female connector having a distal end, with an annular flange extending radially outwardly from the outer periphery of the female connector and axially spaced from the distal end of the female connector so as to selectively abut a distal and of the collar when the distal end of the female connector is inserted into the collar; and a cover having a blind hole receiving the distal end of the female connector and defined to enclose the distal end of the decorative light and having an outer thread formed to correspond to the inner thread in the collar, whereby after the female connector is inserted into the blind hole, rotation of the cover and outer thread relative to the inner thread of the collar will secure the threaded engagement between the cover and the collar such that when the decorative light is not in use the distal end of the decorative light is protected from damage.

2. The plug as claimed in claim 1, wherein the female connector further has a pair of circumferentially spaced keys formed on opposite sides of the outer periphery of the female connector and extending from the distal end of the female connector, and the cover further has a pair of keyways formed on an inner face defining the blind hole to correspond to the keys on the female connector to guide the direction of the cover when the decorative light is inserted into the blind hole of the cover.

* * * * *